US005960698A

United States Patent [19]

Kajinami et al.

[11] Patent Number: 5,960,698

[45] Date of Patent: Oct. 5, 1999

[54] HYDRAULIC CYLINDER

[75] Inventors: Jun Kajinami; Isao Okamoto, both of Ageo; Kazunari Imasato, Yono, all of Japan

[73] Assignees: Nissan Diesel Motor Co., Ltd.; Sanwa Seiki Ltd., both of Saitama, Japan

[21] Appl. No.: 09/031,826

[22] Filed: Feb. 27, 1998

[30] Foreign Application Priority Data

Jun. 13, 1997 [JP] Japan ..... 9-157114

[51] Int. Cl.[6] ..... F01B 7/20

[52] U.S. Cl. ..... 92/52; 92/53

[58] Field of Search ..... 92/51, 52, 53, 92/173

[56] References Cited

U.S. PATENT DOCUMENTS

| | | | |
|---|---|---|---|
| 3,094,900 | 6/1963 | Wandel et al. | 92/51 X |
| 4,388,986 | 6/1983 | Umezawa | 92/52 X |
| 5,020,419 | 6/1991 | Amedei et al. | 92/52 |
| 5,706,712 | 1/1998 | Tischer et al. | 92/52 X |

FOREIGN PATENT DOCUMENTS 5-17243 1/1993 Japan .

*Primary Examiner*—Hoang Nguyen
*Attorney, Agent, or Firm*—Rabin & Champagne, P.C.

[57] ABSTRACT

A small diameter cylinder 1*a* and a large diameter cylinder 1*b* connected to it are formed in a housing, and a stepped piston 8 comprising a large diameter part 8*b* and small diameter part 8*a* is inserted in these cylinders. A first pressure chamber 14*a* is formed on the small diameter cylinder side and a third pressure chamber 14*c* is formed on the large diameter cylinder side by the stepped piston 8, and an annular second pressure chamber 14*b* is formed on the outer circumference of the small diameter part of the stepped piston 8. An intermediate cylinder 10 is formed inside the stepped piston 8, and houses a piston 5 free to slide inside it which forms a fourth pressure chamber 14*d*. The fourth pressure chamber 14*d* is permanently connected to the third pressure chamber 14*c*. A rod 4 connected to the piston 5 passes through the stepped piston 8 in an axial direction. An end stopper 11 limiting the magnum stroke L1 of the piston 5 is provided, and sets the maximum stroke L2 of the stepped piston 8. By controlling the fluid pressure from the first pressure chamber 14*a* to the fourth pressure chamber 14*d*, the stroke of the rod 4 mentioned above can be stopped in the four positions 0, L1, L2, and L1+L2.

5 Claims, 13 Drawing Sheets

Three stage positioning cylinder

| | | Solenoid valve | | |
|---|---|---|---|---|
| | | 15a | 15b | 15c |
| Position | F | | ○ | ○ |
| | N | | ○ | |
| | R | ○ | | |

FIG. 9

Four stage positioning cylinder

| | | Solenoid valve | | |
|---|---|---|---|---|
| | | 15a | 15b | 15c |
| Position | 1 | | ○ | ○ |
| | 2 | ○ | | ○ |
| | 3 | | ○ | |
| | 4 | ○ | | |

FIG. 10

HYDRAULIC CYLINDER

FIELD OF THE INVENTION

The present invention relates to a hydraulic cylinder which permits in three stage or four stage positioning.

BACKGROUND OF THE INVENTION

In a vehicle transmission, hydraulic cylinders are used as shift actuators and as select actuators for driving a gear shift mechanism (e.g. Japanese Patent Application Hei 5-17243 published by the Japanese Patent Office in 1994).

In this disclosure, hydraulic cylinders for shift and select operation are controlled by fluid pressure supplied via a solenoid valve by a microcomputer, and when the vehicle issues a speed change request, the hydraulic cylinders drive a gear shift mechanism to a required position.

In this case, a three stage positioning function is required of the hydraulic cylinders. A conventional cylinder which permits three stage positioning is shown in FIG. 13.

Two free pistons 211, 212 are housed in the cylinder 206, and a piston 210 is accommodated between them. The piston 210 is fixed to a rod 201 passing through the cylinder 206. A pressure chamber 202 facing the free piston 211 and a pressure chamber 203 facing the free piston 211 are provided inside the cylinder 206, these pressure chambers 202, 203, being connected to a high pressure air supply via solenoid valves 204, 205.

In the state shown in the figure, when high pressure air is supplied to the pressure chamber 202 via the solenoid valve 204 and the pressure chamber 203 is opened to the atmosphere via the solenoid valve 205, the free piston 211 and piston 210 are displaced due to the pressure acting on its pressure-receiving surface.

The free piston 211 stops in an intermediate position shown in the figure corresponding to a midway stage, but the piston 210 displaces to the right of the figure until it comes in contact with the right-hand end of the cylinder 206.

When high pressure air is supplied to the pressure chamber 203 via the solenoid valve 205 from this state, and the pressure chamber 202 is opened to the atmosphere via the solenoid valve 204, the free piston 212 and piston 210 displace together to the left due to the pressure acting on the pressure-receiving surfaces of the free piston 212 and piston 210.

When the intermediate position (neutral position) shown in the figure is reached, the free piston 212 comes in contact with a step and stops in that position, but the piston 210 continues moving to the left together with the other free piston 211 until it comes in contact with the left-hand end of the cylinder 206.

On the other hand, when high pressure air is simultaneously supplied to the pressure chamber 202 and pressure chamber 203 via the solenoid valve 204 and solenoid valve 205, the piston 210 displaces to the neutral position together with the free pistons 211, 212, and stops in this position.

In this case, the rod 201 can be positioned in three stages by opening and closing the solenoid valves 204, 205, i.e. a maximum extension amount and minimum extension amount, and an intermediate position (neutral position) between these extremes.

However when the pressure chambers 202, 203 are opened to the atmnosphere after stopping the solenoid valves 204, 205 in the neutral position, and there is a difference in the response of the solenoid valves 204, 205 or pressure losses in the passages, or there is a difference in the capacities of the pressure chambers 202, 203, a pressure difference is easily established on either side of the piston 210 so that the working pressure acting on the piston 210 is unbalanced, and the piston 210 therefore moves or "drifts" towards the left or right.

To correct this drift, a high-speed response solenoid may be used, a throttle to adjust unbalance of pressure drop may be provided in a passage, or the resistance of a load connected to an output shaft may be added.

There is some scatter in the response speed of solenoid valves, and their response speed may vary according to the supply voltage and supply pressure. An attempt is often made to resolve this problem by providing a high pressure air discharge passage, increasing the sliding resistance of the piston, or using a control system which allows for drift.

However, some fluctuation of the vehicle battery voltage cannot be avoided. Decreasing the resistance of passages or reducing the left-right difference between pressure chambers requires the design layout to be symmetrical. This limits the degree of freedom of design, and necessarily makes the hydraulic cylinder larger and heavier.

In a control system wherein such drift is assumed to occur, during a select operation in the neutral position, it is first necessary to hold the neutral position by a shift hydraulic cylinder. This introduces a delay into the control, and also increases the consumption amount of compressed air.

Also, when a transmission had one reverse gear and seven forward gears, a hydraulic cylinder was required which could be positioned in three stages as a shift actuator, and a hydraulic cylinder was required which could be positioned in four stages as a select actuator.

If two types of hydraulic cylinder are provided, as they respectively have different components, manufacturing costs are increased compared to the case where only one hydraulic cylinder is manufactured.

SUMMARY OF THE INVENTION

It is therefore an object of the present invention to provide a hydraulic cylinder which can be precisely positioned without drift in any stroke position.

It is a further object of this invention to manufacture a hydraulic cylinder which permits three stage positioning and a hydraulic cylinder which permits four stage positioning while suppressing production costs by using a large number of common parts.

In order to achieve these objectives, the present invention has a hydraulic cylinder operated by a fluid pressure. The hydraulic cylinder comprises a small diameter cylinder and a large diameter cylinder connected to it inside a housing, a stepped piston having a large diameter part free to slide in the large diameter cylinder and a small diameter part free to slide in the small diameter cylinder, a first pressure chamber formed on the side of the small diameter cylinder and a third pressure chamber formed on the side of the large diameter cylinder by the stepped piston, an annular second pressure chamber formed on the outer circumference of the small diameter part of the stepped piston, an intermediate cylinder formed inside the stepped piston and opening into the first pressure chamber, a piston inserted free to slide and forming a fourth pressure chamber in the intermediate cylinder, a passage permanently connecting the second pressure chamber and the fourth pressure chamber, a rod connected with the piston and passing through the stepped piston in an axial direction, an end stopper for limiting the maximum stroke of the piston to L1, means for limiting the maximum stroke of the stepped piston to L2, and a first valve for controlling the fluid pressure in the first pressure chamber, a second valve for controlling the fluid pressure in the second pressure chamber and the fourth pressure chamber and a third valve for controlling the fluid pressure in the third pressure chamber, wherein by selectively controlling fluid pressures via the first, second and third valves, the rod is made to stop in four stroke positions 0, L1, L2 and L1+L2.

It is preferable that the maximum stroke L1 of the piston and the maximum stroke L2 of the stepped piston are set such that L1=L2.

It is further preferable that a shift lever having a gear shift function is connected to the rod.

It is further preferable that a spacer which sets the maximum stroke L1 of the piston and the maximum stroke L2 of the stepped piston such that L1=L2/2.

It is further preferable that a shift lever having a gear shift function is connected to the rod.

According to the present invention, a rod stroke can be stopped in four positions 0, L1, L2, L1+L2 so as to perform four stage positioning by selectively opening and dosing first—third solenoid valves.

By setting L1=L2, the rod stroke may be stopped at three equidistant positions, i.e. 0, L1(L1=L2), L1+L2 by selectively opening and dosing the first–third solenoid valves. Three stage positioning may therefore be controlled.

Further, by setting L1=L2/2, the rod stroke may be stopped at four equidistant positions 0, L1, L2, L1+L2 by selectively opening and dosing the first–third solenoid valves. In this case, as the parts are the same as for a hydraulic cylinder which permits three stage positioning excepting for a spacer, the hydraulic cylinder may be adapted for three stage positioning or four stage positioning depending on whether or not the spacer is fitted. In other words, the productivity of these two types of cylinder may be increased by using the same parts for both types.

A more complete understanding of the invention can be had by reference to the following detailed description in view of accompanying drawings.

BRIEF DESCRIPTION OF THE DRAWINGS

FIG. 9 is a descriptive diagram showing an operating pattern of solenoid valves for three stage positioning.

FIG. 10 is a descriptive diagram showing an operating pattern of the solenoid valves for four stage positioning.

DETAILED DESCRIPTION

Figure 1:
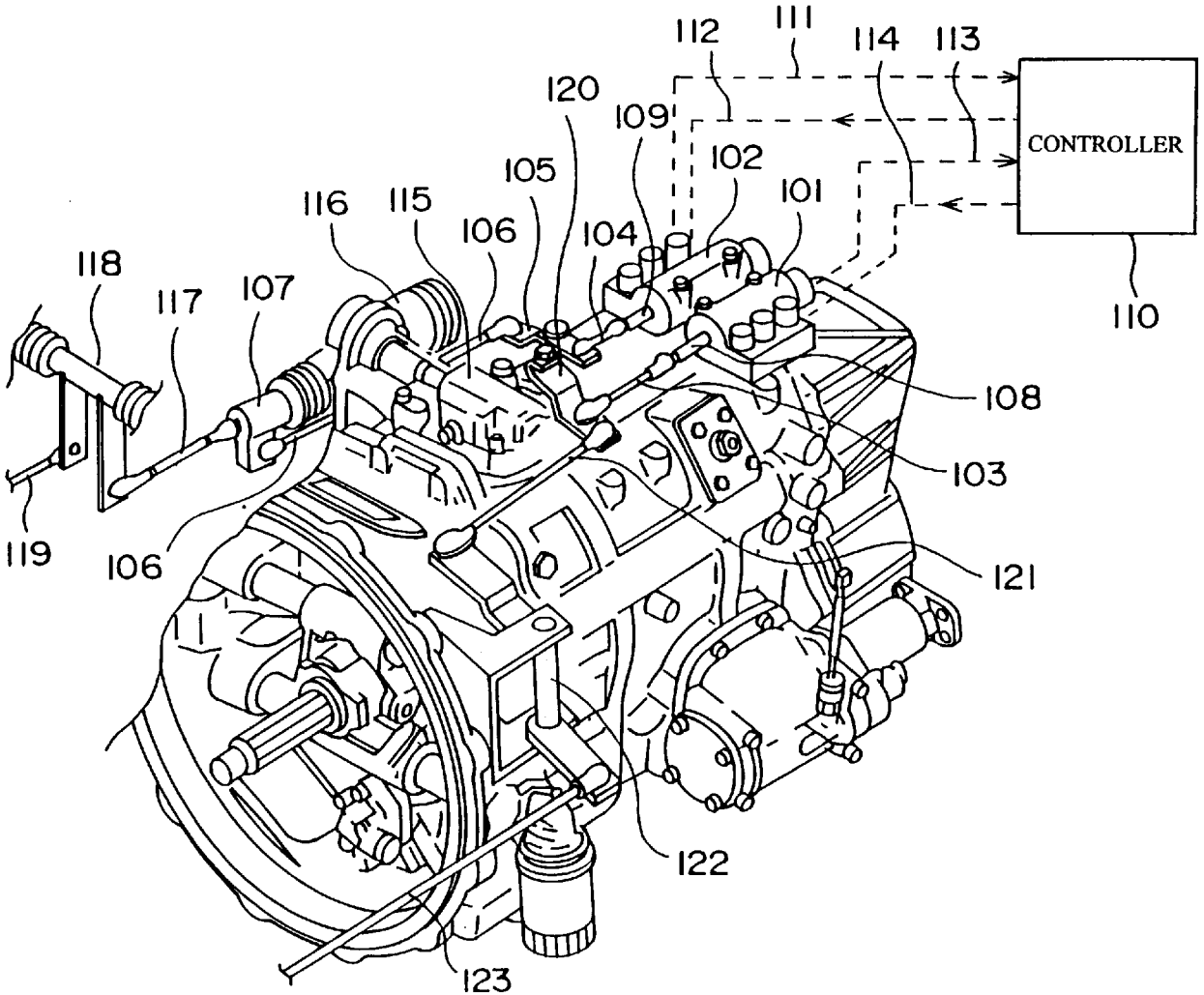
FIG. 1 is a perspective view showing an example in which the hydraulic cylinder of this invention is applied to a speed change controller of a transmission.

FIG. 1 shows a speed change controller of a transmission which uses a hydraulic cylinder according to the present invention.

This transmission in which speed change control is performed automatically or manually, comprises one stage reverse gear and seven stage forward gears. 102 is a hydraulic cylinder which permits three stage positioning as a shift actuator, and 101 is a hydraulic cylinder which permits four stage positioning as a select actuator, An output shaft 109 of the hydraulic cylinder 102 for shift operation is connected via a link rod 104 to one end of a reversing lever 105, and it is connected to an input shaft 107 of a power shifter 116 via a link rod 106 from the other end of the reversing lever 105.

An output shaft 108 of the hydraulic cylinder 101 for select operation is connected via a link rod 103 by a select lever 120 of the transmission.

An output shaft, not shown, of the power shifter 116 is connected to a shift lever of the transmission.

A mechanical, manual speed change mechanism which transmits a select operation and shift operation due to a manual speed change in the drver's compartment, to the select lever 120 and the shift lever of the transmission, comprises linkages 119, 123 in the driver's compartment and link rods 117, 121 on the transmission side for each transmission path, and lever devices 118, 122 are interposed between them.

The input shaft 107 of the power shifter 116 is connected via the link rod 117 to one end of the lever device 118, and the linkage 119 is connected to the other end of the lever device 118.

The select lever 120 of the transmission is connected via the link rod 121 to one end of the lever device 122, and the linkage 123 is connected to the other end of the lever device 122.

Sensors, not shown, for detecting the stroke positions of the output shafts 108, 109 are installed respectively in the hydraulic cylinders 101, 102, and corresponding detection signals 113, 111 are input to the controller 110.

When the controller 110 issues a speed change request based on the running state of the vehicle, or a speed change request based on an arbitrary operation, control signals 112, 114 are output to the hydraulic cylinders 101, 102 so that the gear position of the transmission is shifted to the required gear position.

When a means, not shown, is provided to issue a request to change over to a manual, mechanical speed change operation, and such a change-over request is received, the controller 110 stops gear shift control of the transmission, and releases the hydraulic cylinders 101, 102 so that they are free.

During generation of the change-over request to manual speed change operation, speed change operations are performed from the driver's compartment. This shift operation is transmitted to the link rod 117 via the lever device 118 from the linkage 119, and the shift lever of the transmission is driven by the output of the power shifter 116.

A select operation is transmitted to the link rod 121 via the lever device 122 from the linkage 123, and drives the select lever 120 of the transmission.

In other words when a manual speed change operation is required, as the hydraulic cylinders 101, 102 are free, speed change of the transmission (one stage reverse gear, seven stage forward gears) is performed by a mechanical speed change mechanism driven manually from the driver's compartment.

Figure 2:
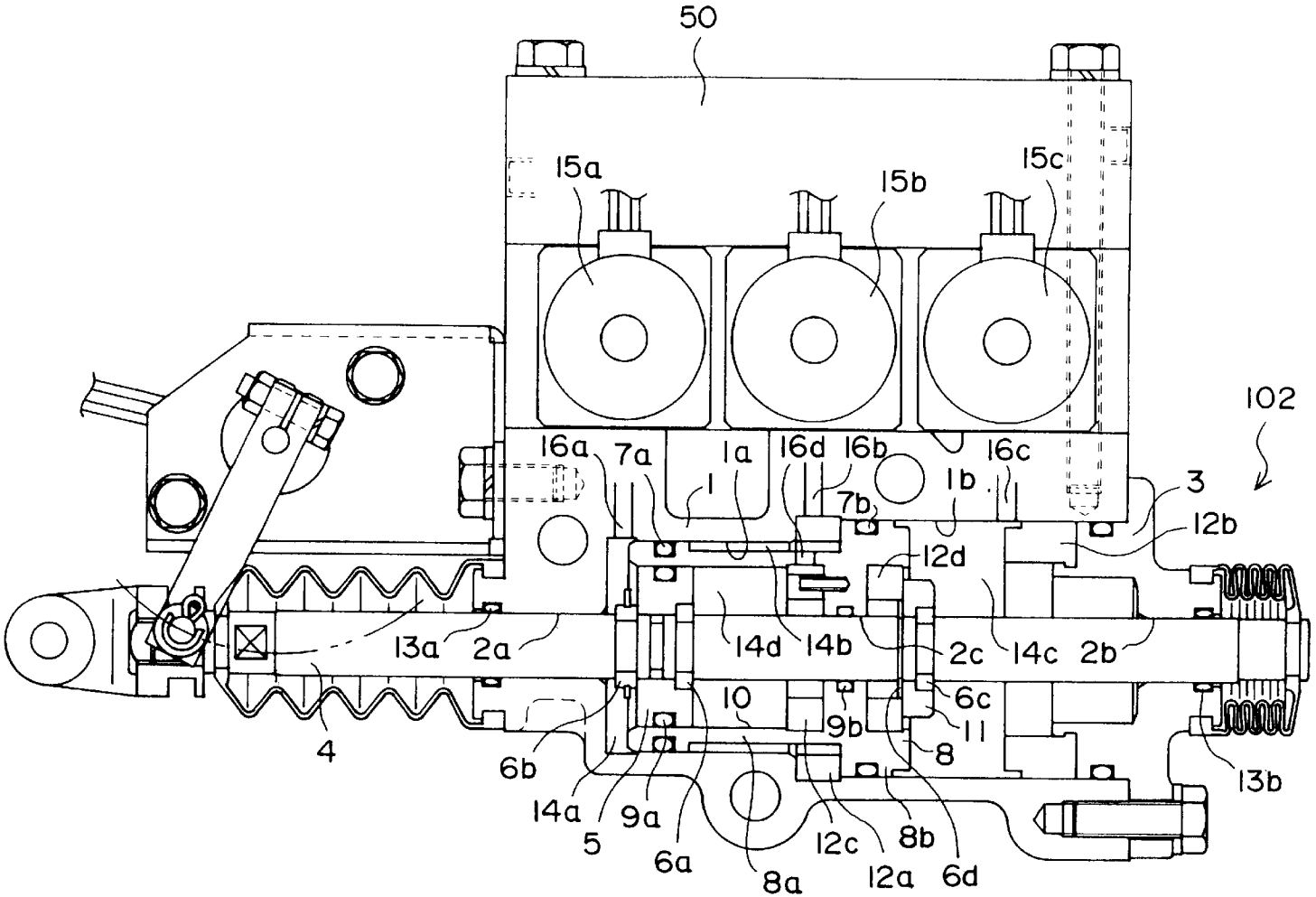
FIG. 2 is a cross-sectional view of part of a hydraulic cylinder in which three stage positioning is possible.
Figure 3:
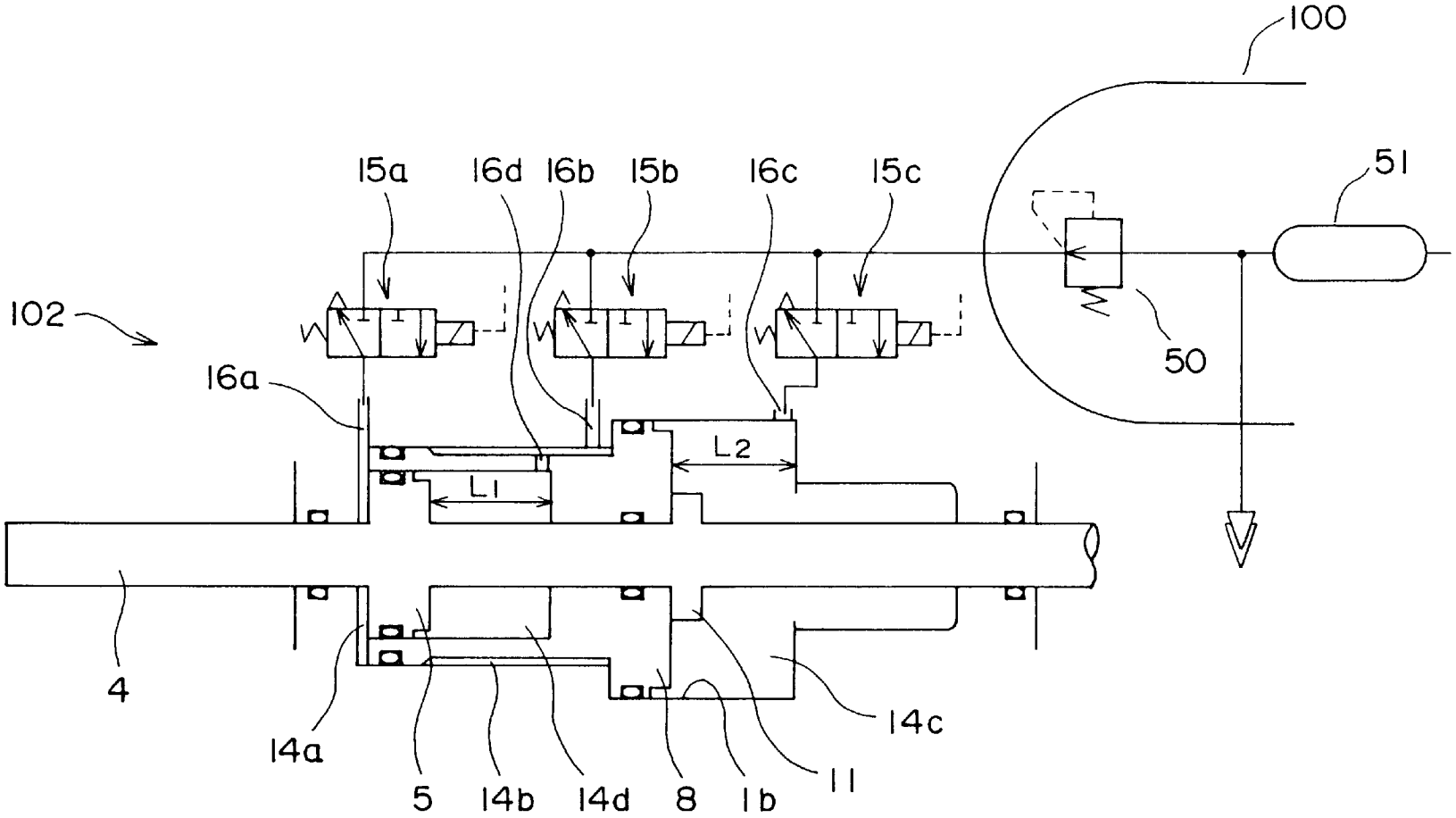
FIG. 3 is a schematic view of the hydraulic cylinder in which three stage positioning is possible.

FIG. 2, FIG. 3 show the construction of the hydraulic cylinder 102 capable of three stage positioning for shift operation.

A large diameter cylinder 1*b* is formed in a housing 1, and a small diameter cylinder 1*a* is coaxially connected at the rear. A bearing 2*a* is provided coaxially with the cylinders 1*a*, 1*b* at the front of the small diameter cylinder 1*a* in the housing 1.

One end of the large diameter cylinder 1*b* of the housing 1 is open, and an end cap 3 is fitted to seal this opening. A bearing 2*b* is formed coaxially with the cylinders 1*a*, 1*b* in the end cap 3, and a rod 4 penetrates these bearings 2*a*, 2*b* such that it is free to slide.

A piston 8 which is formed stepped shape in its middle part is housed in the cylinders 1*a*, 1*b*. This stepped piston 8 comprises a large diameter part 8*b* free to slide in the small diameter cylinder 1*a* and a small diameter part 8*a* free to slide in the large diameter cylinder 1*b*, and the aforementioned rod 4 penetrates its center through a bearing 2*c* such that the rod 4 is free to slide. An annular pressure chamber 14*b* (second pressure chamber) is formed between an outer circumference of the small diameter part 8*a* and inner circumference of the cylinders 1*a*, 1*b*. The small diameter part 8*a* is formed in a cylindrical shape, and an intermediate cylinder 10 is provided inside it.

A piston 5 free to slide is provided in the intermediate cylinder 10. The piston 5 is fixed in a predetermined position on the rod 4 via stoppers 6*a*, 6*b*. An end stopper 11 is fixed via stoppers 6*c*, 6*d* in a predetermined position on the opposite side enclosing the piston 5 and bearing 2*c*.

A pressure chamber 14*d* (fourth pressure chamber) is formed in the intermediate cylinder 10 by the piston 5, and a passage 16*d* which permanently connects this pressure chamber 14*d* to an outer pressure chamber 14*b* is formed in the intermediate cylinder 10.

A pressure chamber 14*a* (first pressure chamber) is formed in the small diameter cylinder and a pressure chamber 14*c* (third pressure chamber) is formed in the large diameter cylinder by the stepped piston 8 which houses the piston 5.

These pressure chambers 14*a* to 14*c* are connected to the solenoid valves 15*a* to 15*c* via passages 16*a* to 16*c*. The solenoid valves 15*a* to 15*c* supply compressed air to and discharge compressed air from the pressure chambers 14*a* to 14*c*, and are connected to a high pressure air supply 100. The high pressure air supply 100 comprises an air reservoir 51 which stores compressed air from an air compressor (not shown), and a pressure reducing valve 50 to regulate the supply pressure to the solenoid valves 15*a*, 15*b* to a predetermined value.

Dampers 12*c*, 12d are installed on both sides enclosing the bearing 2*c* of the stepped piston 8 in order to damp collisions between the. stepped piston 8, and the piston 5 and end stopper 11 on either side of the stepped piston 8.

Dampers 12*a*, 12*b* are installed at both ends of the large diameter cylinder 1*b* in order to damp collisions with the large diameter part 8*b* of the stepped piston 8.

In this case, the relation between the maximum stroke L1 of the piston 5 and the maximum stroke L2 of the stepped piston 8 is set to L1=L2 so that the hydraulic cylinder is capable of three stage positioning. 9*a* is a seal which seals a slide surface between the piston 5 and the intermediate cylinder 10. 7*a* is a seal which seals a slide surface between the small diameter part 8*a* of the stepped piston 8 and the small diameter cylinder 1*a*. 7*b* is a seal which seals a slide surface between the large diameter part 8*b* and the small diameter cylinder 1*b*. 9*b* is a seal which seals a slide surface between the bearing 2*c* and the rod 4. 13*a*, 13*b* are seals which seal a slide surface between the bearings 2*a*, 2*b* on both sides of the cylinders 1*a*, 2*b* and the rod.

When the solenoid valves 15*a* to 15*c* are OFF, the pressure chambers 14*a* to 14*d* are open to the atmosphere. In this state, when the rod 4 is operated by an outside force, the range of the sum of the maximum stroke L1 of the piston 5 and maximum stroke L2 of the stepped piston 8 (L1+L2) can be set arbitrarily.

When compressed air is sent selectively into the solenoid valves 15*a* to 15*c*, three stage positioning of the rod 4 is performed. This operation will now be described based on FIG. 3 and FIG. 4.

FIG. 9 represents the operating pattern of the solenoid valves 15*a* to 15*c*.

Figure 4:
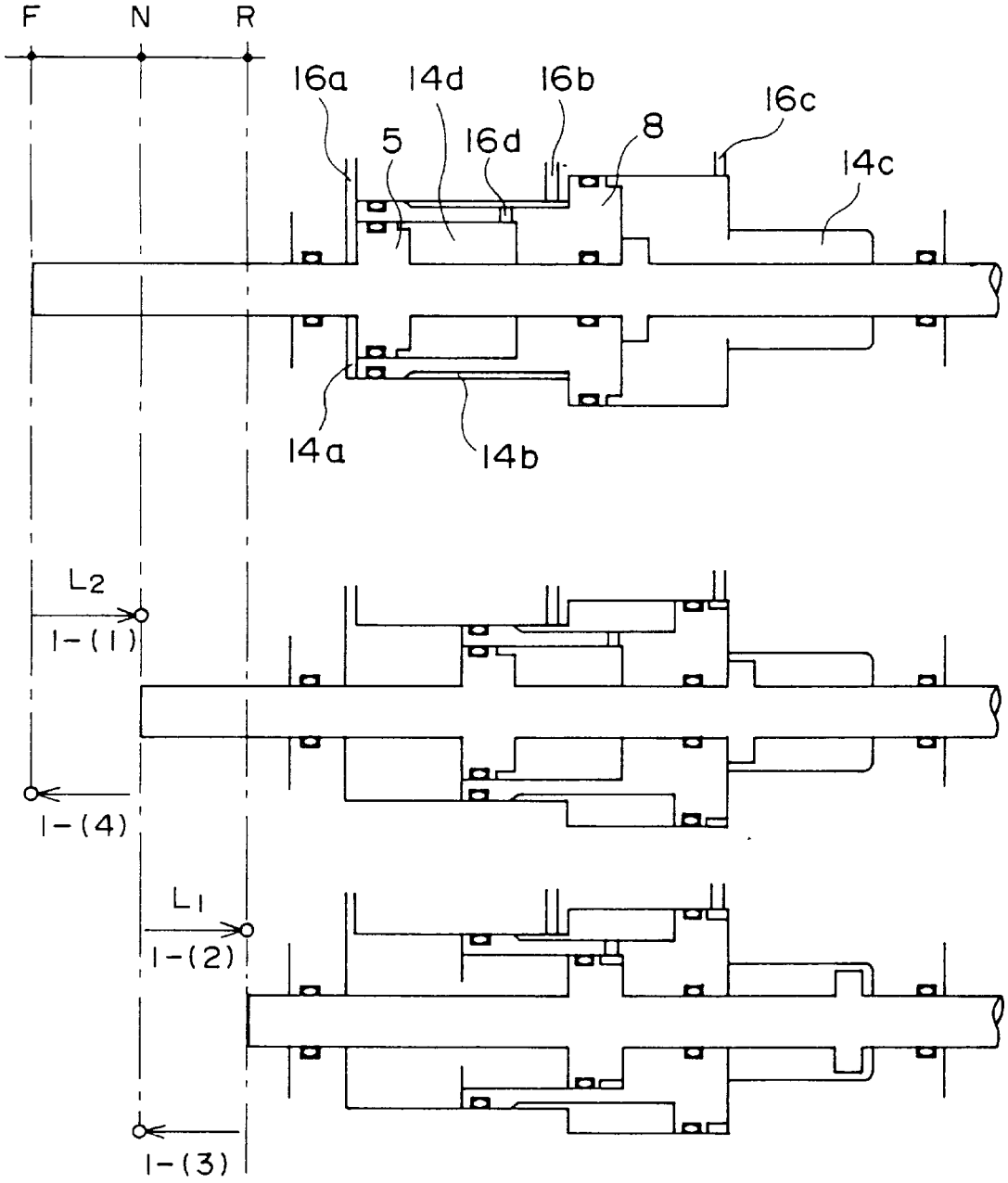
FIG. 4 is a descriptive diagram showing a three stage positioning operation.

In FIG. 4, when the end of the rod 4 is displaced from a position F to a position N, the solenoid valve 15*b* switches ON and compressed air is supplied to the pressure chamber 14*b*. At the same time, the solenoid valves 15*a*, 15*c* switch OFF and the pressure chambers 14*a*, 14*c* open to the atmosphere. Due to the switching ON of the solenoid valve 15*b*, the pressure of the pressure chamber 14*b* rises, and the pressure of the pressure chamber 14*d* connected to the pressure chamber 14*b* via the passage 16*d* also rises.

Due to the pressure rise of the pressure chamber 14*d*, the piston 5 moves together with the rod 4 inside the intermediate cylinder 10, and stops when the end stopper 11 strikes the stepped piston 8.

Due to the pressure acting on the pressure chamber 14*b*, the stepped piston 8 displaces a distance L2 in a direction toward the right side of the figure, i.e. in a direction tending to compress the pressure chamber 14*c*, and comes in contact with the end of the large diameter cylinder 1*b* (damper 12*b*). The rod 4 therefore displaces together with the motion of the stepped piston 8, its end displaces a distance L2 from position F, and stops in position N as shown by 1-(1).

After stopping in the position N, the solenoid valve 15*b* switches OFF.

High pressure air in the pressure chambers 14*b*, 14*d* is discharged via the passages 16*b*, 16*d*. During discharge of high pressure air, the pressure chambers 14*b*, 14*d* are at a pressure higher than atmospheric pressure.

On the other hand, as the pressure chambers 14*a*, 14*c* are at atmospheric pressure, the aforesaid relation between the pistons 5 and 8 is maintained, and they stop in this position. Displacement (drift) of the rod 4 therefore does not occur.

When the end of the rod 4 is displaced from position N to a position R, the solenoid valve 15*a* switches ON, and high pressure air is supplied to the pressure chamber 14*a*. At the same time, the solenoid valves 15*b*, 15*c* switch OFF and the pressure chambers 14*b*, 14*c* open to the atmosphere.

Due to the pressure of the pressure chamber 14*a*, the piston 5 displaces a distance L1 toward the rear of the intermediate cylinder 10, and comes in contact with the end of the intermediate cylinder 10 (damper 12*c*). Also, the pressure of the pressure chamber 14*a* pushes the stepped piston 8 in such a direction as to compress the pressure chamber 14*c*.

As the stepped piston 8 is in contact with the base end of the large diameter cylinder 1*b*, it cannot move in this direction. The end of the rod 4 therefore retreats a distance L1 from the position N and stops in the position R as shown by 1-(2). After stopping in the position R, the solenoid valve 15*a* switches OFF, and high pressure air in the pressure chamber 14*a* is discharged via the passage 16*a*.

During discharge of high pressure air, the pressure of the pressure chamber 14*a* falls to atmospheric pressure while the piston 5 and stepped piston 8 are held such that they cannot move. The rod 4 therefore does not displace in the axial direction.

When the end of the rod 4 is displaced from position R to position N, the solenoid valve 15*b* switches ON and high pressure air is supplied to the pressure chambers 14*b*, 14*d*. At the same time, the solenoid valves 15*a*, 15*c* switch OFF and the pressure chambers 14*a*, 14*c* open to the atmosphere.

Pressure acts on the pressure-receiving surface of the stepped piston 8 facing the pressure chamber 14*b* and the stepped piston 8 is pushed in a direction tending to compress the pressure chamber 14*c*, but as it is in contact with the base end of the large diameter cylinder 1*b*, it cannot move further.

Due to the pressure of the pressure chamber 14*d*, the piston 5 displaces a distance L1 from the base of the intermediate cylinder 10 in such a direction as to enlarge the pressure chamber 14*d*, and it stops when the end stopper 11 comes in contact with the pressure-receiving surface of the stepped piston 8.

The end of the rod 4 therefore advances by a distance L1 from the position R and stops in the position N as shown by 1-(3).

When it stops in the position N, the solenoid valve 15*b* switches OFF. High pressure air in the pressure chambers 14*b*, 14*d* is discharged via the passages 16*b*, 16*d*. During discharge of high pressure air, as the pressure in the pressure chambers 14*b*, 14*d* falls below atmospheric pressure while the stepped piston 8 and piston 5 are held stationary, there is no drift of the rod 4.

When the end of the rod 4 is displaced from position N to a position F, the solenoid valves 15*b*, 15*c* switch ON, and high pressure air is supplied to the pressure chambers 14*b*, 14*c*, while on the other hand the solenoid valve 15*a* switches OFF and the pressure chamber 14*a* opens to the atmosphere.

There are three possible operating sequences for the solenoid valve 15*b* and solenoid valve 15*c*, i.e.:

(1) The solenoid valve 15*c* switches ON after the solenoid valve 15*b* switches ON, (2) The solenoid valve 15*b* switches ON after the solenoid valve 15*c* switches ON, (3) The solenoid valve 15*b* and solenoid valve 15*c* are switched ON simultaneously.

Any of the situations (1)–(3) is feasible.

Describing first the case (1), high pressure air is supplied via the passage 16*b* due to switching on of the solenoid valve 15*b*, and the pressure of the pressure chambers 14*b* and 14*d* rises. This pressure acts in such a direction as to enlarge the pressure chambers 14*b*, 14*d*. It pushes the stepped piston 8 in a direction where it is pressed against the end of the large diameter cylinder 1*b*, and simultaneously pushes the piston 5 in a direction away from the stepped piston 8.

When the solenoid valve 15*c* switches on after the solenoid valve 15*b*, high pressure air is supplied to the pressure chamber 14*c* via the passage 16*c*. The pressure of the pressure chamber 14*c* rises, and acts to displace the stepped piston 8 in a such a direction as to enlarge the pressure chamber 14*c*. In the early stage of the pressure rise, working pressure based on the pressure of the pressure chamber 14*b* is predominant, so the stepped piston 8 does not displace. However, when the pressure of the pressure chamber 14*c* rises further and the condition of the following expression is satisfied, the stepped piston 8 begins to displace.

[Pressure of pressure chamber 14*c*]>[Pressure of pressure chamber 14*b*]×[pressure-receiving surface area of stepped piston 8 facing pressure chamber 14*b*]/[pressure-receiving surface area of stepped piston 8 facing pressure chamber 14*c*] {1}

In other words, when the condition of equation {1}is met, the stepped piston 8 starts to move in such a direction as to enlarge the volume of pressure chamber 14*c*, and it is displaced by a distance L2 limited by a step (damper 12*a*) of the large diameter cylinder 1*b*.

Meanwhile, the piston 5 is pushed by the pressure of the pressure chamber 14*d* in such a direction as to enlarge the volume of the chamber while being limited by the end stopper 11, so the end of the rod 4 advances by a distance L2 from position N and stops in the position F as shown by 1-(4).

After stopping in position F, the solenoid valves 15*b*, 15*c* are switched to the OFF position. The operating sequence of the solenoid valves 15*b*, 15*c* may be:

(1) The solenoid valve 15*c* switches OFF after the solenoid valve 15*b* switches OFF, (2) The solenoid valve 15*b* switches OFF after the solenoid valve 15*c* switches OFF, (3) The solenoid valves 15*b*, 15*c* switch OFF simultaneously.

When the relation between the pressure of the pressure chamber 14*c* and the pressure of the pressure chamber 14*b* does not satisfy the condition of the above equation {1}, the stepped piston 8 moves.

In case (1), the condition of equation {1}will definitely be met.

In case (2), it may easily occur that the condition of equation {1}is not met.

In case (3), the pressure of the pressure chamber 14*c* decreases as the pressure of the pressure chamber 14*b* decreases, but as pressure decreases faster in the pressure chamber 14*b*, the condition of inequality {1}is satisfied.

Figure 5:
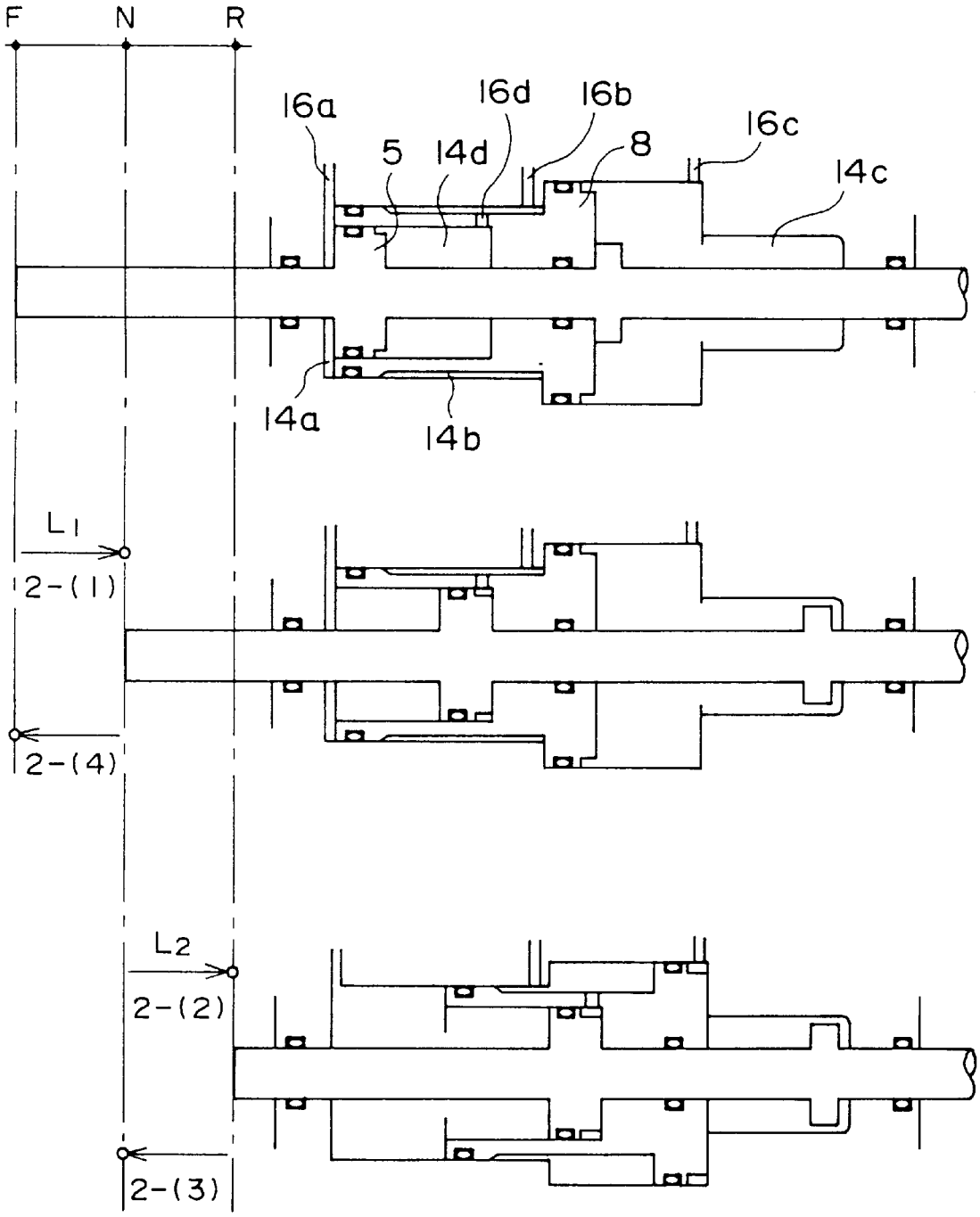
FIG. 5 is a descriptive diagram showing a three stage positioning operation

FIG. 5 illustrates another operating mode for three stage positioning of the rod 4. When the end of the rod 4 is displaced from position F to position N, the solenoid valves 15*a*, 15*c* switch ON, and high pressure air is supplied to the pressure chambers 14*a*, 14*c*. At the same time, the solenoid valve 15*b* switches OFF, and the pressure chamber 14*b* opens to the atmosphere.

The operating sequence of the solenoid valve 15*a* and solenoid valve 15*c* may be:

(1) The solenoid valve 15*c* switches ON after the solenoid valve 15*a* switches ON, (2) The solenoid valve 15*a* switches ON after the solenoid valve 15*c* switches ON, (3) The solenoid valve 15*a* and solenoid valve 15*c* switch ON simultaneously.

If only the final position is important, the same result is obtained in all the above cases (1)–(3), but with the aim of preventing excess movement during the operating process, the condition of the following equation must be met.

[Pressure of pressure chamber 14*c*]>[Pressure of pressure chamber 14*a*]×[pressure-receiving surface area of stepped piston 8 facing pressure chamber 14*a*+pressure-receiving surface area of piston 5 facing pressure chamber 14*a*]/[pressure-receiving surface area of stepped piston 8 facing pressure chamber 14*c*] {2}

Cases (2) and (3) meet this condition (2) well, but case (2) is to be preferred. Describing now case (2), when the solenoid valve 15*c* switches ON, high pressure air is supplied to the pressure chamber 14*c* via the passage 16*c*, and the pressure of the pressure chamber 14*c* rises. This pressure acts on the pressure-receiving surface of the stepped piston 8 facing the pressure chamber 14*c*, and the stepped piston 8 displaces in a direction tending to enlarge the volume of the pressure chamber 14*c*, but the movement is limited by a step of the large diameter cylinder 1*b*.

When the solenoid valve 15*a* switches ON after the solenoid valve 15*c* switches ON, high pressure air is supplied to the pressure chamber 14*a* via the passage 16*a*. The pressure of the pressure chamber 14*a* rises, and tends to cause the stepped piston 8 and piston 5 to displace in a direction enlarging the volume of pressure chamber 14*a*, but as the working pressure on the side of the pressure chamber 14*c* is predominant for the stepped piston 8, it remains stationary. The piston 5 displaces a distance L1 towards the rear of the intermediate cylinder 10, and comes in contact with the base of the intermediate cylinder 10.

Subsequently, as the relation between the pressure of the pressure chamber 14*a* and the pressure of the pressure chamber 14*c* satisfies the condition of the above inequality {2}, the stepped piston 8 and piston 5 do not displace. The end of the rod 4 therefore retreats a distance L1 from the position F and stops in position N as shown by 2-(1). After stopping in position N, the solenoid valves 15*a*, 15*c* switch OFF.

Here, the following operating sequences are possible, i.e.:

(1) The solenoid valve 15*c* switches OFF after the solenoid valve 15*a* switches OFF, (2) The solenoid valve 15*a* switches OFF after the solenoid valve 15*c* switches OFF, (3) The solenoid valve 15*a* and the solenoid valve 15*c* switch OFF simultaneously.

The condition of the following equation must be satisfied to prevent drift of the rod 4 when the solenoids 15*a*, 15*c* switch OFF.

[Pressure of pressure chamber 14*c*]>[Pressure of pressure chamber 14*a*]×[pressure-receiving surface area of stepped piston 8 facing pressure chamber 14*a*+pressure-receiving surface area of piston 5 facing pressure chamber 14*a*]/[pressure-receiving surface area of stepped piston 8 facing pressure chamber 14*c*] {3}

Cases (1) and (3) satisfy the condition of this equation {3}, but case (1) is to be preferred.

Describing case (1), when the solenoid valve 15*a* switches OFF, the pressure of the pressure chamber 14*a* decreases. If the solenoid 15*c* switches OFF after the pressure in the pressure chamber 14*a* has sufficiently decreased, the pressure in the pressure chambers 14*a*, 14*c* can be decreased to atmospheric pressure while continuing to fully satisfy equation {3}. When the end of the rod 4 displaces from position N to position R, the solenoid valve 15*a* switches ON and high pressure air is supplied to the pressure chamber 14*a*. At the same time, the solenoid valves 15*b*, 15*c* switch OFF, and the pressure chambers 14*b*, 14*c* open to the atmosphere. High pressure air is supplied via the passage 16*a* to the pressure chamber 14*a*, and the pressure of the pressure chamber 14*a* rises.

Pressure acts on the pressure-receiving surface of the stepped piston 8 facing the pressure chamber 14*a* and the pressure-receiving surface of the piston 5. The stepped piston 8 therefore displaces together with the piston 5 by a distance L2 in a direction tending to enlarge the volume of the pressure chamber 14*a*, and comes in contact with the end of the large diameter cylinder 1*b*. The end of the rod 4 therefore retreats a distance L2 from position N and stops in position R as shown by 2-(2). After stopping in the position R, the solenoid valve 15*a* switches OFF. High pressure air in the pressure chamber 14*a* is discharged via the passage 16*a*. During discharge of high pressure air, as the pressure of the pressure chamber 14*a* is higher than that of the pressure chambers 14*b*–14*d*, the piston 5 and the stepped piston 8 are pushed in a direction tending to enlarge the pressure chamber 14*a*.

In other words, the pressure of the pressure chamber 14*a* decreases to atmospheric pressure while the motion of the stepped piston 8 and piston 5 is restricted. Drift of the rod 4 therefore does not occur.

When the end of the rod 4 displaces from position R to position N, the solenoids- 15*a*, 15*c* switch ON and high pressure air is supplied to the pressure chambers 14*a*, 14*c*. At the same time, the solenoid 15*b* switches OFF, and the pressure chamber 14*b* opens to the atmosphere.

Here, the following operating sequences of the solenoids 15*a*, 15*b* are possible, i.e.:

(1) The solenoid valve 15*c* switches ON after the solenoid valve 15*a* switches ON, (2) The solenoid valve 15*a* switches ON after the solenoid valve 15*c* switches ON, (3) The solenoid valve 15*a* and the solenoid valve 15*c* switch ON simultaneously.

Even when the solenoid 15*a* is OFF, the stepped piston 8 and the piston 5 can be moved a distance L2 together towards the small diameter cylinder 1*a* due to the solenoid 15*c* switching ON. However when the rod 4 reaches the position N, the stepped piston 8 comes in contact with a step of the large diameter cylinder 1*b* and stops quickly, whereas the piston 5 maintains its displacement speed and may overshoot due to inertia.

To prevent overshooting, the stepped piston 8 must be displaced while the piston 5 is pushed against the base of the intermediate cylinder 10 by the pressure of the pressure chamber 14*a*.

In case (1), the piston 5 (i.e. rod 4) may definitively be prevented from overshooting, but the conditions under which the stepped piston 8 begins to move (i.e. equation {2}above) are not immediately satisfied.

In case (2), on the other hand, the stepped piston 8 begins to move at an early point in time, but the piston 5 tends to overshoot.

In case (3), high pressure air is supplied simultaneously to the pressure chambers 14*a*, 14*c*, but in view of the volume of these pressure chambers 14*a*, 14*c*, pressure rises faster in the pressure chamber 14*a*. As a result, displacement to the position N begins fairly early while overshoot of the piston 5 is definitively prevented.

After stopping in position N, the solenoid valves 15*a*, 15*c* switch OFF. At that time, in order to prevent drift of the rod 4, the solenoid valve 15*c* switches OFF after the solenoid valve 15*a* switches OFF.

When the end of the rod 4 is displaced from position N to position F, the solenoid valves 15*b*, 15*c* switch ON, and high pressure air is supplied to the pressure chambers 14*b*, 14*c*, while on the other hand, the solenoid valve 15*a* switches OFF and the pressure chamber 14*a* opens to the atmosphere.

There are three possible operating sequences for the solenoid valve 15*b* and solenoid valve 15*c*, i.e.:

(1) The solenoid valve 15*c* switches ON after the solenoid valve 15*b* switches ON, (2) The solenoid valve 15*b* switches ON after the solenoid valve 15*c* switches ON, (3) The solenoid valve 15*b* and solenoid valve 15*c* are switched ON simultaneously.

Case (2) is the most desirable from the viewpoint of preventing irregular motion during the operation, and this case will therefore be described here.

When the solenoid valve 15*c* switches ON, the pressure of the pressure chamber 14*c* rises. Pressure acts on the pressure-receiving surface of the stepped piston 8 facing the pressure chamber 14*c* and the stepped piston 8 displaces in a direction tending to enlarge the pressure chamber 14*c*, but the motion is limited by a step of the large diameter cylinder 1*b* and the stepped piston 8 is maintained in the stationary state.

When the solenoid valve 15*b* switches ON after the solenoid valve 15*c* switches ON, the pressure in the pressure chamber 14*b* and pressure chamber 14*d* rises.

Pressure acts on the pressure-receiving surface of the stepped piston 8 facing the pressure chamber 14*b*, but as the working pressure acting on the pressure-receiving surface facing the pressure chamber 14*c* is predominant, the stepped piston 8 is held stationary.

Pressure acts on the pressure-receiving surface of the piston 5 facing the pressure chamber 14*d*, and the piston 5 is displaced in such a direction as to enlarge the pressure chamber 14*d*.

When the piston 5 moves a distance L1 and the end stopper 11 comes in contact with the stepped piston 8, further displacement is prevented.

The end of the rod 4 therefore advances a distance L1 from position N and stops in position F as shown by 2-(4). After stopping in position F, the solenoid valves 15*b*, 15*c* switch OFF.

The operating sequence may be:

(1) The solenoid valve 15*c* switches OFF after the solenoid valve 15*b* switches OFF, (2) The solenoid valve 15*b* switches OFF after the solenoid valve 15*c* switches OFF, (3) The solenoid valves 15*b*, 15*c* switch OFF simultaneously.

In order to prevent drift of the rod 4, high pressure air in the pressure chambers 14*b*, 14*c* must be discharged while satisfying the condition of equation {1}.

In case (1), the condition of equation {1}is satisfied best.

In case (2), it may easily occur that the condition of equation {1}is not satisfied.

In case (3), the pressure in the pressure chambers 14*b*, 14*c* decreases simultaneously, however it decreases faster in the pressure chamber 14*b* and the condition of inequality {1}is satisfied.

Figure 6:
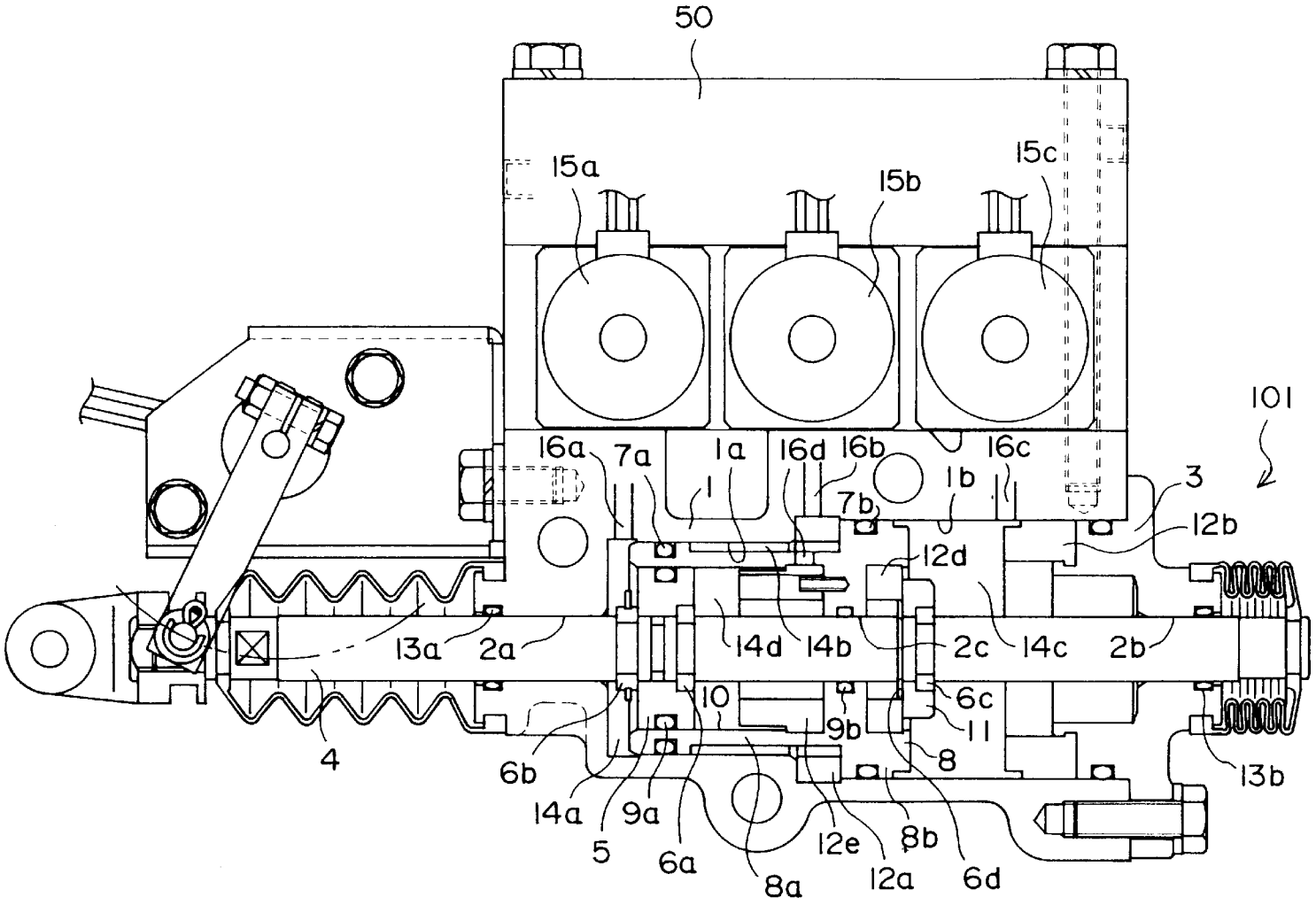
FIG. 6 is a cross-sectional view of part of a hydraulic cylinder in which four stage positioning is possible.
Figure 7:
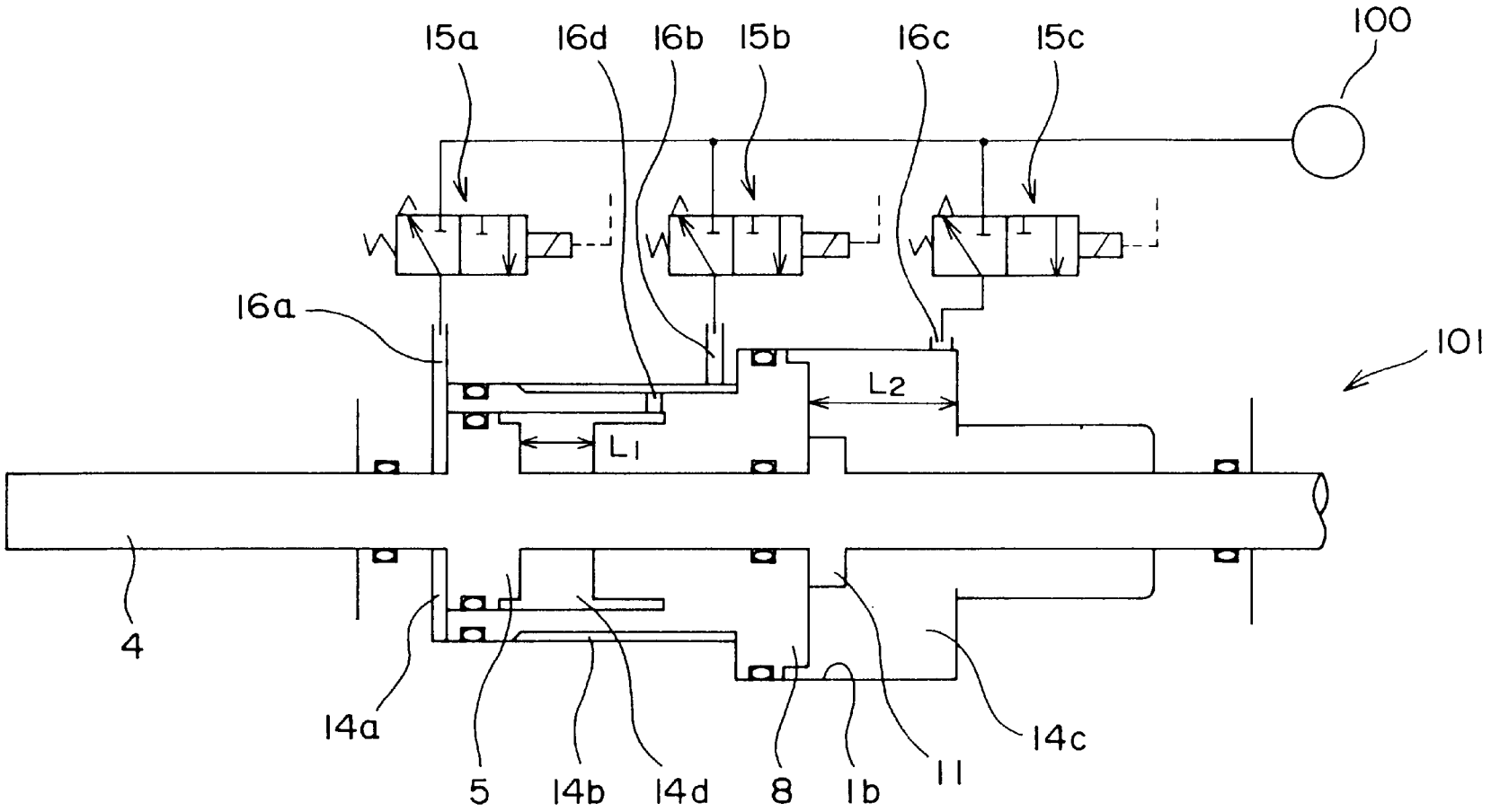
FIG. 7 is a schematic view of the hydraulic cylinder in which four stage positioning is possible.

FIG. 6, FIG. 7 show another embodiment of the present invention, wherein the hydraulic cylinder 101 can be positioned in four stages (FIG. 1).

A damper 12*e* (spacer) is attached to the base of the intermediate cylinder 10 instead of the damper 12*c* in the hydraulic cylinder 102 of FIG. 2 so as to modify the relation between the maximum stroke L1 of the piston 5 and the maximum stroke L2 of the stepped piston 8.

The same manual are assigned to the same parts as in FIG. 2, a description of which is not repeated here.

Apart from the damper 12*e*, the same parts are used as in the hydraulic cylinder 101 which has three stage positioning. In other words, depending on whether the damper 12*c* or 12*e* is installed, the arrangement can function either as the shift hydraulic cylinder 102 or as the select hydraulic cylinder 101.

Every effort is made to use the same parts so that productivity in manufacturing these two types of hydraulic cylinders 101, 102 is greatly improved.

Figure 8:
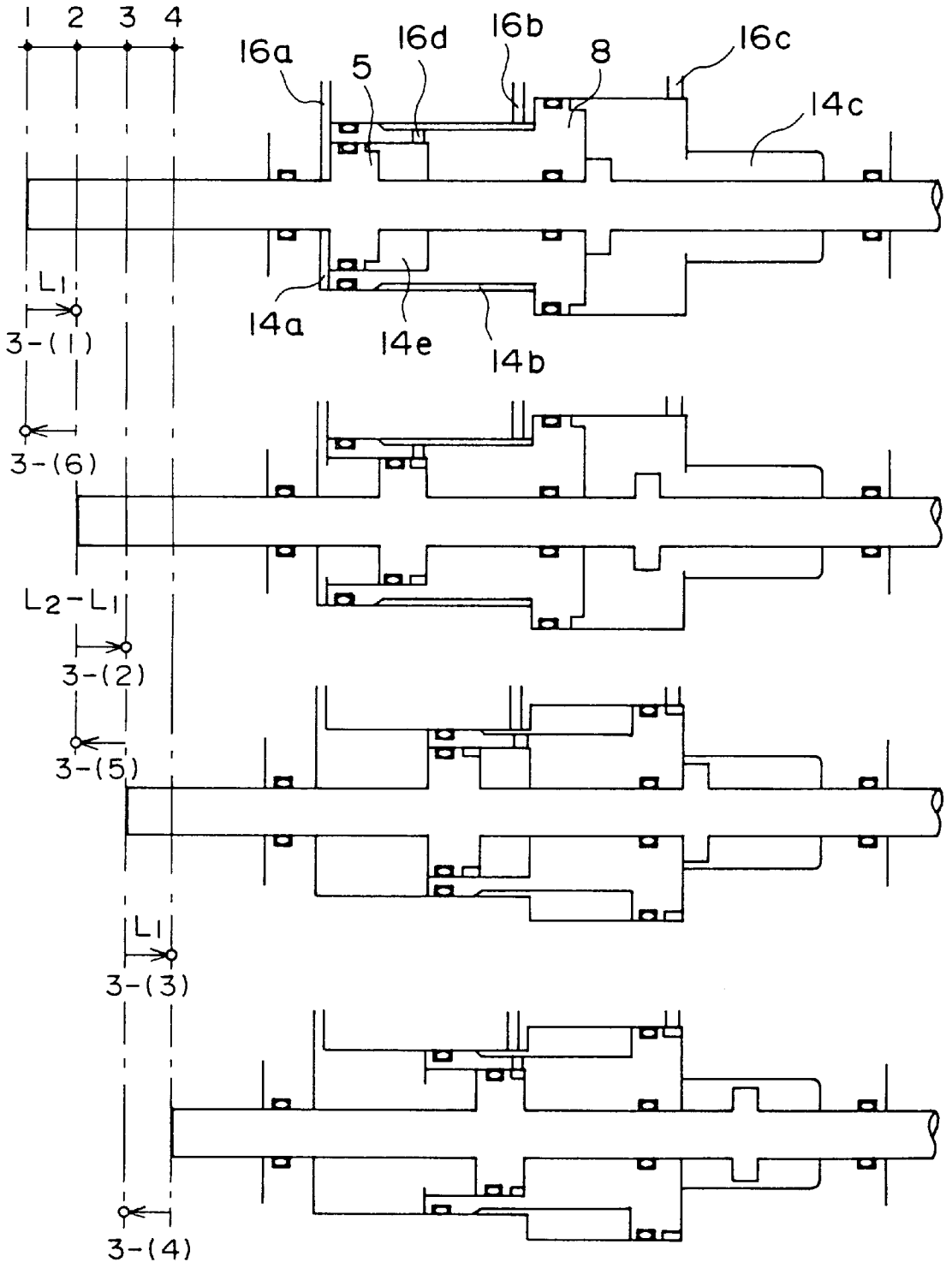
FIG. 8 is a descriptive diagram showing a four stage positioning operation.

FIG. 8 describes the operation of the four stage positioning hydraulic cylinder 101.

FIG. 10 shows the operating pattern of the solenoid valves 15*a*–15*c*.

When the end of the rod 4 displaces from a position 1 to a position 2, the solenoid valves 15*a*, 15*c* switch ON and high pressure air is supplied to the pressure chambers 14*a*, 14*c*. At the same time, the solenoid valve 15*b* switches OFF and the pressure chamber 14*b* opens to the atmosphere.

The operating sequence of the solenoid valves 15*a*, 15*b* may be:

(1) The solenoid valve 15*c* switches ON after the solenoid valve 15*a* switches ON, (2) The solenoid valve 15*a* switches ON after the solenoid valve 15*c* switches ON, (3) The solenoid valves 15*a*, 15*c* switch ON simultaneously.

For the purpose of final positioning, the same result is obtained in all of the above cases (1)–(3), but for the purpose of preventing overshoot in the operating process, the condition of the aforesaid equation {2}must be satisfied.

From this viewpoint, case (2) or (3) is satisfactory but case (2) is to be preferred. Describing case (2), when the solenoid valve 15*c* switches ON, the-pressure in the pressure chamber 14*c* rises. This pressure acts on the pressure-receiving surface of the stepped piston 8 facing the pressure chamber 14*c*, and the stepped piston 8 displaces in a direction tending to enlarge the volume of the pressure chamber 14*c*, but the movement is limited by a step of the large diameter cylinder 1*b* (damper 12*a*).

When the solenoid valve 15*a* switches ON after the solenoid valve 15*c* switches ON, high pressure air is supplied to the pressure chamber 14*a* via the passage 16*a*.

The pressure of the pressure chamber 14*a* rises, and tends to cause the stepped piston 8 and piston 5 to displace in a direction enlarging the volume of pressure chamber 14*a*, but, as the working pressure on the side of the pressure chamber 14*c* is predominant for the stepped piston 8, it remains stationary.

The piston 5 displaces a distance L1 toward the rear of the intermediate cylinder 10, and comes in contact with the base (damper 12*e*) of the intermediate cylinder 10.

Subsequently, as the relation between the pressure of the pressure chamber 14*a* and the pressure of the pressure chamber 14*c* satisfies the condition of the above inequality {2}, the stepped piston 8 and piston 5 do not displace.

The end of the rod 4 therefore retreats a distance L1 from position 1 and stops in position 2 as shown by 3-(1). After stopping in position 2, the solenoid valves 15*a*, 15*c* switch OFF.

Here, the following operating sequences are possible, i.e.:

(1) The solenoid valve 15*c* switches OFF after the solenoid valve 15*a* switches OFF, (2) The solenoid valve 15*a* switches OFF after the solenoid valve 15*c* switches OFF, (3) The solenoid valve 15*a* and the solenoid valve 15*c* switch OFF simultaneously.

As described above, the condition of inequality {2}must be satisfied to prevent drift of the rod 4. From this viewpoint, case (1) or case (3) is satisfactory, but case (1) is to be preferred.

Describing case (1), when the solenoid valve 15*a* switches OFF, the pressure in the pressure chamber 14*a* decreases. When the pressure in the pressure chamber 14*a* has sufficiently decreased and the solenoid valve 15*c* switches OFF, the pressure in the pressure chambers 14*a*, 14*c* can be decreased to atmospheric pressure while fully satisfying the condition of inequality {2}.

When the end of the rod 4 displaces from position 2 to position 3, the solenoid valve 15*b* switches ON and compressed air is supplied to the pressure chamber 14*b*. At the same time, the solenoid valves 15*a*, 15*c* switch OFF and the pressure chambers 14*a*, 14*c* open to the atmosphere.

Due to the pressure of the pressure chamber 14*d*, the piston 5 displaces a distance L1 in such a direction as to enlarge the pressure chamber 14*d*, but its further displacement is limited by the end stopper 11. Due to the pressure in the pressure chamber 14*b*, the stepped piston 8 displaces in a direction tending to compress the pressure chamber 14*c*, and comes in contact with the base of the large diameter cylinder (damper 12*b*).

The end of the rod 4 therefore retreats a distance L2-L1 and stops in position 3 as shown by 3-(2). After stopping in position 3, the solenoid valve 15*b* switches OFF. High pressure air in the pressure chambers 14*b*, 14*d* is discharged via the passages 16*b*, 16*d*. During discharge of high pressure air, the piston 5 is pushed in a direction tending to enlarge the pressure chamber 14*d* and the stepped piston 8 is pushed in a direction tending to enlarge the pressure chamber 14*b*.

In other words, as the pressure in the pressure chambers 14*b*, 14*d* decreases to atmospheric pressure while the motion of the piston 5 is limited by the end stopper 11 and the stepped piston 8 is pressed against the base of the large diameter cylinder 1*b*, drift of the rod 4 does not occur. When the end of the rod 4 is displaced from position 3 to position 4, the solenoid valve 15*a* switches ON, and compressed air is supplied to the pressure chamber 14*a*. At the same time, the solenoid valves 15*b*, 15*c* switch OFF and the pressure chambers 14*b*, 14*c* open to the atmosphere.

Due to the pressure of the pressure chamber 14*a*, the piston 5 displaces a distance L1 in a direction tending to compress the pressure chamber 14*d*, and comes in contact with the base of the intermediate cylinder 10.

The pressure of the pressure chamber 14*a* acts also on the stepped piston 8 in such a direction as to compress the pressure chamber 14*c*, but as the stepped piston 8 is in contact with the base end of the large diameter cylinder 1*b*, it remains stationary.

The end of the rod 4 therefore displaces a distance L1 from the position 3 and stops in position 4 as shown by 3-(3). After stopping in position 4, the solenoid valve 15*a* switches OFF.

As the pressure chambers 14*b*, 14*d* and 14*c* are at atmospheric pressure, the pressure in the pressure chamber 14*a* falls to atmospheric pressure while the piston 5 and intermediate cylinder 10 are held so that they cannot move (when the pressure chamber 14*a* is enlarged to the maximum). The position of the rod 4 therefore does not change.

When the end of the rod 4 is displaced from position 4 to position 3, the solenoid valve 15*b* switches ON and high pressure air is supplied to the pressure chamber 14*b*. At the same time, the solenoid valves 15*a*, 15*c* switch OFF and the pressure chambers 14*a*, 14*c* open to the atmosphere.

Due to the pressure of the pressure chamber 15*b*, the stepped piston 8 is pressed against the base of the large diameter cylinder 1*b*. Due to the pressure of the pressure chamber 14*d*, the piston 5 displaces a distance L1 in a direction tending to enlarge the pressure chamber 14*d*, and when the end stopper 11 comes in contact with the stepped piston 8, further displacement is prevented.

The end of the rod 4 therefore displaces a distance L1 and stops in position 3 as shown by 3-(4). After stopping in position 3, the solenoid valve 5*b* switches OFF. High pressure air in the pressure chambers 14*b*, 14*d* is discharged via the passages 16*b*, 16*d*. The pressure in the pressure chambers 14*b*, 14*d* decreases to atmospheric pressure while the piston 5 and stepped piston 8 are pushed in such a direction as to enlarge the volumes of these chambers. Drift of the rod 4 therefore does not occur.

When the rod 4 moves from position 3 to position 2, the solenoid valves 15*a*, 15*c* switch ON and high pressure is supplied to the pressure chambers 14*a*, 14*c*. At the same time, the solenoid valve 15*b* switches OFF, and the pressure chamber 14*b* opens to the atmosphere.

Due to the pressure of the pressure chamber 14*a*, the piston 5 displaces a distance L1 in a direction tending to compress the pressure chamber 14*d*, and comes in contact with the base of the intermediate cylinder 10.

Due to the pressure of the pressure chamber 14*c*, the stepped piston 8 displaces a distance L2 in a direction tending to compress the pressure chamber 14*b*, and comes in contact with the base of the large diameter cylinder 1*b* The end of the rod 4 therefore displaces a distance L2-L1 from position 2 and stops in position 2 as shown by 3-(5).

The operating sequence of the solenoid valves 15*a*, 15*b* may be:

(1) The solenoid valve 15*c* switches ON after the solenoid valve 15*a* switches ON, (2) The solenoid valve 15*a* switches ON after the solenoid valve 15*c* switches ON, (3) The solenoid valves 15*a*, 15*c* switch ON simultaneously.

Due to inertia when the stepped piston 8 comes in contact with a step on the large cylinder 1*b*, the motion of the piston 5 must be suppressed by the pressure of the pressure chamber 14*a* so that the piston 5 does not overshoot.

Case (1) is most effective in preventing overshoot of the piston 5, but the rod 4 then takes more time to displace. In cases (2) and (3), overshoot of the piston 5 is still suppressed, but from the viewpoint of reducing displacement time of the rod 4, the operating sequence (3) is to be preferred.

After the rod has stopped in position 2, the solenoid valves 15*a*, 15*c* switch OFF.

To prevent drift of the rod 4, the operating sequence must be such that the pressure in the pressure chambers 14*a*, 14*c* is reduced to atmospheric pressure while satisfying the condition of the aforesaid inequality {2}, so it is desirable to switch the solenoid valve 15*c* OFF after the solenoid valve 15*a* switches OFF.

When the rod displaces from position 2 to position 1, the solenoid valves 15*b*, 15*c* switch ON and high pressure air is supplied to the pressure chambers 14*b*, 14*c*. At the same time, the solenoid valve 15*a* switches OFF and the pressure chamber 14*a* opens to the atmosphere.

Regarding the operating sequence of the solenoid valves 15*b*, 15*c*, from the viewpoint of preventing drift of the rod 4, it is preferred that the solenoid valve 15*b* switches ON after the solenoid valve 15*c*.

Describing this case, when the solenoid valve 15*c* switches ON, the pressure in the pressure chamber 14*c* rises. Due to this pressure, the stepped piston 8 is pushed in a direction tending to compress the pressure chamber 14*b*, but its displacement in this direction is limited by a step on the large diameter cylinder 1*b*.

When the solenoid valve 15*b* switches ON after the solenoid valve 15*c*, due to the pressure in the pressure chamber 14*d*, the piston 5 displaces a distance L1 in a direction tending to enlarge the pressure chamber 14*d*, but its other displacement is prevented by the end stopper 11.

This pressure acts also on the pressure-receiving surface of the stepped piston 8 facing the pressure chamber 14*b*, but as the applied force based on the pressure of the pressure chamber 14*c* is predominant, the stepped piston 8 is held in a stationary state.

The end of the rod 4 therefore displaces a distance L1 from position 2 and stops in position 1 as shown by 3-(6). After stopping in position 1, the solenoid valves 15*b*, 15*c* switch OFF.

The operating sequence may be:

(1) The solenoid valve 15*c* switches OFF after the solenoid valve 15*b* switches OFF, (2) The solenoid valve 15*b* switches OFF after the solenoid valve 15*c* switches OFF, (3) The solenoid valves 15*b*, 15*c* switch OFF simultaneously.

From the viewpoint of preventing drift of the rod 4, cases (1) and (3) are preferred but case (1) is most preferable.

In case (2) it may easily occur that the condition of inequality {1}is not satisfied, so this operating sequence is not desirable.

Describing case (1), when the solenoid valve 15*b* switches OFF, high pressure air in the pressure chambers 14*b*, 14*c* is discharged via the passage 16*b*. During this discharge, as the pressure on the pressure chamber 14*d* is higher than that in the pressure chamber 14*a*, the end stopper 11 of the piston 5 is pressed by the pressure in the pressure chamber 14*d* against the pressure-receiving surface of the stepped piston 8.

When the solenoid valve 15*c* switches OFF after the solenoid valve 15*b* switches OFF, the pressure in the pressure chamber 14*c* decreases. As the relation between the pressures in the pressure chamber 14*b*, 14*c* satisfies the condition of inequality {1}, the stepped piston 8 does not move in a direction tending to compress the pressure chamber 14*c*.

Figure 11:
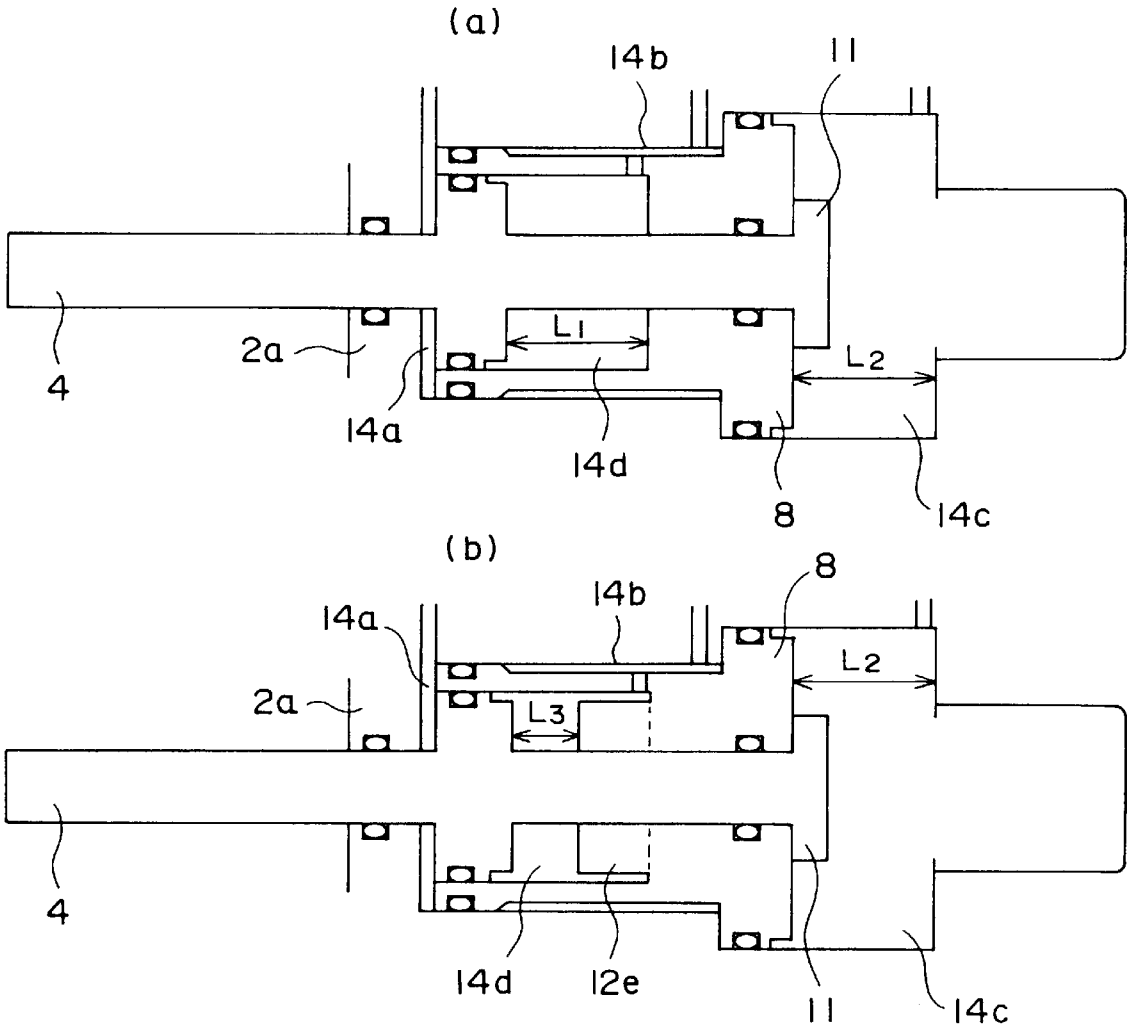
FIG. 11(*a*), (*b*) are descriptive diagrams respectively showing the operating state of the hydraulic cylinder.
Figure 12:
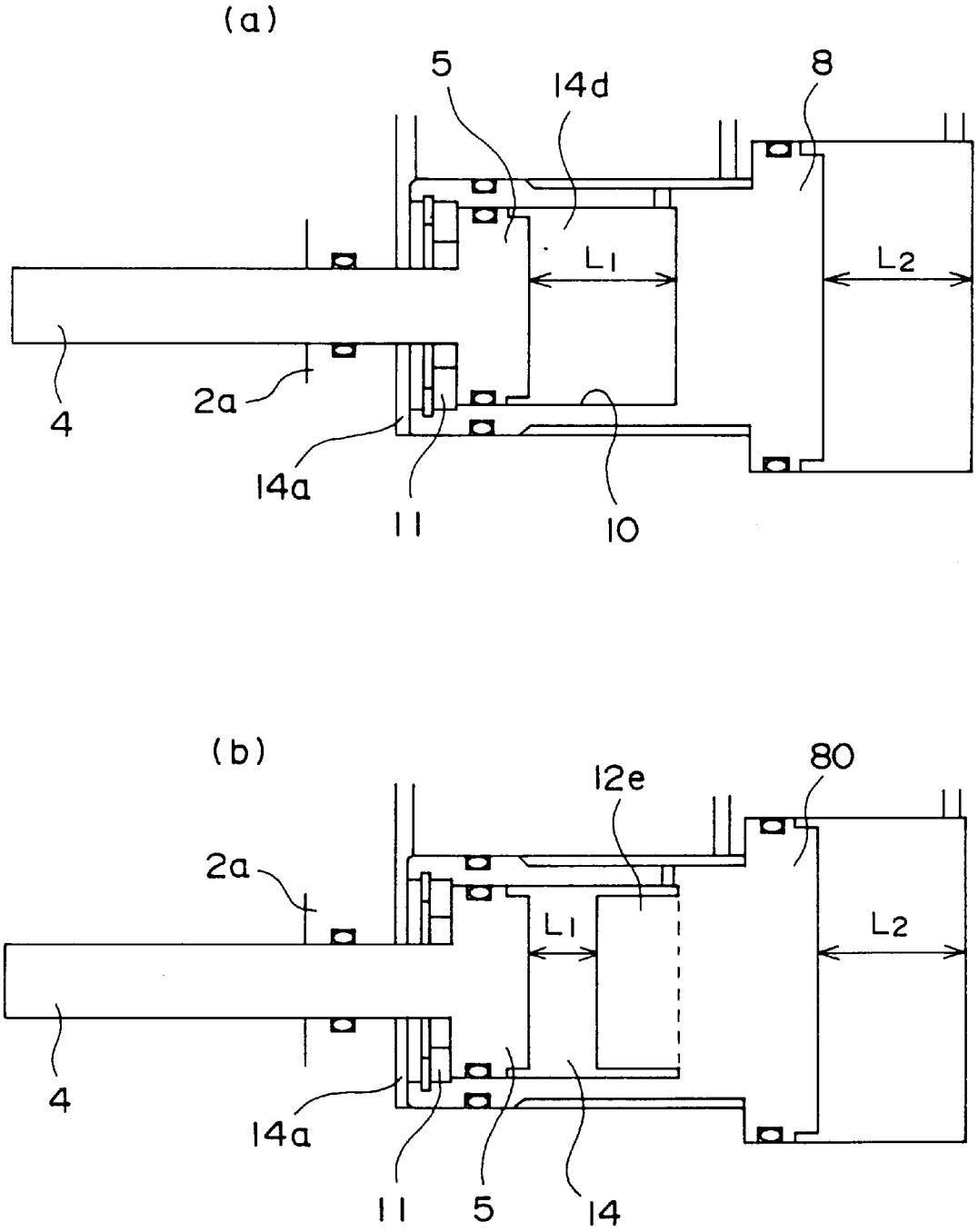
FIG. 12(*a*), (*b*) are descriptive diagrams respectively showing the operating state of the hydraulic cylinder.
Figure 13:
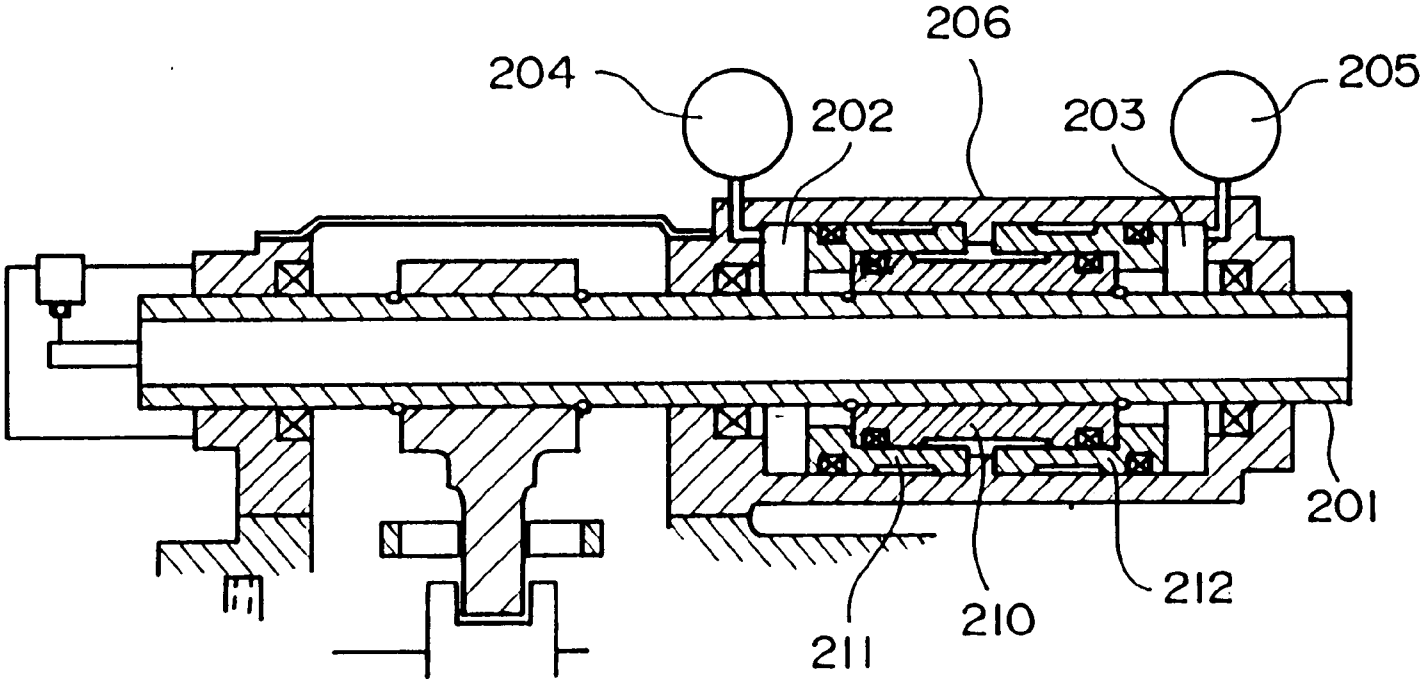
FIG. 13 PRIOR ART
FIG. 13 is a schematic view of a conventional hydraulic cylinder.

FIG. 11, FIG. 12 show different embodiments of this invention. In these figures, (a) shows the hydraulic cylinder 102 capable of three stage positioning, and (b) shows the hydraulic cylinder 101 capable of four stage positioning.

FIG. 11 is different from the preceding embodiments in that the bearing (2*b* in FIG. 1 and FIG. 6) of the large cylinder 1*b* is not used for the shift hydraulic cylinder 102 of FIG. 2 and the select hydraulic cylinder 101 of FIG. 6.

Also, the rod 4 terminates at the end stopper 11 on one side, so that it extends outside only from the bearing 2*a* of the small diameter cylinder 1*a* on the other side.

In FIG. 12, in the hydraulic cylinders 102, 101 of FIG. 2 and FIG. 6, the rod 4 terminates at the piston 5 on one side. The bearing of the large diameter cylinder 1*b* (2*b* in FIG. 1 and FIG. 6) and the bearing of the stepped piston 8 (2*c* in FIG. 2 and FIG. 6) are omitted.

The end stopper 11 which limits the maximum stroke of the piston 5 is attached to the opening of the intermediate cylinder 10.

In FIG. 11 and FIG. 12, parts with the same functions as those of FIG. 2 and FIG. 6 are assigned the same symbols.

As the operation of the cylinders having these alternative constructions is identical to that shown in FIG. 4, FIG. 5 and FIG. 8, its description is omitted here.

Although particular embodiments of the invention have been illustrated in the drawings and described in the detailed description, it will be understood that the invention is not limited to the embodiments disclosed, but is intended to embrace any alternatives, modifications, equivalents and/or substitutions of elements as fall within the scope of the invention as defined by the following claims.

What is claimed:

1. A hydraulic cylinder operated by a fluid pressure, comprising:

a small diameter cylinder and a large diameter cylinder connected to it inside a housing, a stepped piston having a large diameter part free to slide in said large diameter cylinder and a small diameter part free to slide in said small diameter cylinder, a first pressure chamber formed on the side of said small diameter cylinder and a third pressure chamber formed on the side of said large diameter cylinder by said stepped piston, an annular second pressure chamber formed on the outer circumference of said small diameter part of said stepped piston, an intermediate cylinder formed inside said stepped piston and opening into said first pressure chamber, a piston inserted free to side and forming a fourth pressure chamber in said intermediate cylinder, a passage permanently connecting said second pressure chamber and said fourth pressure chamber, a rod connected with said piston and passing through said stepped piston in an axial direction, an end stopper for limiting the maximum stroke of said piston to L1, means for limiting the maximum stroke of said stepped piston to L2, a first valve for controlling the fluid pressure in said first pressure chamber, a second valve for controlling the fluid pressure in said second pressure chamber and said fourth pressure chamber and a third valve for controlling the fluid pressure in said third pressure chamber, wherein by selectively controlling fluid pressures via said first, second and third valves, said rods made to stop in four stroke positions 0, L1, L2 and L1+L2.

2. A hydraulic cylinder as defined in claim 1, wherein the maximum stroke L1 of said piston and the maximum stroke L2 of said stepped piston are set such that L1=L2.

3. A hydraulic cylinder as defined in claim 2, wherein a shift lever having a gear shift function is connected to said rod.

4. A hydraulic cylinder as defined in claim 1, comprising a spacer which sets the maximum stroke L1 of said piston and the maximum stroke L2 of said stepped piston such that L1=L2/2.

5. A hydraulic cylinder as defined in claim 4, wherein a shift lever having a gear shift function is connected to said rod.

* * * * *